US006722543B1

(12) United States Patent
Fitzgerald et al.

(10) Patent No.: US 6,722,543 B1
(45) Date of Patent: Apr. 20, 2004

(54) BACKPACK WITH ADJUSTABLE LUMBAR SUPPORT BELT

(76) Inventors: Karen Fitzgerald, P.O. Box 9280, Santa Rosa, CA (US) 95405; Deborah Bugel, 115 Cresta Vista Dr., San Francisco, CA (US) 94127

( * ) Notice: Subject to any disclaimer, the term of this patent is extended or adjusted under 35 U.S.C. 154(b) by 37 days.

(21) Appl. No.: 10/179,831

(22) Filed: Jun. 24, 2002

(51) Int. Cl.[7] ..... A45C 15/00

(52) U.S. Cl. ..... 224/583; 224/628; 224/637; 224/647; 224/652

(58) Field of Search ..... 224/581, 582, 224/583, 628, 630, 631, 637, 647, 650, 652

(56) References Cited

U.S. PATENT DOCUMENTS 4,318,502 A * 3/1982 Lowe et al. ..... 224/153
4,424,841 A * 1/1984 Smith ..... 224/240
5,184,763 A * 2/1993 Blaisdell et al. ..... 224/153
5,240,156 A * 8/1993 Sicotte et al. ..... 224/583
5,540,364 A * 7/1996 Krieger et al. ..... 224/153
5,615,812 A * 4/1997 Martin ..... 224/153
5,628,443 A * 5/1997 Deutsch ..... 224/583
5,934,527 A * 8/1999 Von Neumann ..... 224/153
6,189,750 B1 * 2/2001 Von Neumann ..... 224/153
6,609,642 B2 * 8/2003 Heinz et al. ..... 224/637

* cited by examiner

*Primary Examiner*—Stephen K. Cronin
(74) *Attorney, Agent, or Firm*—Goldstein Law Offices P.C.

(57) ABSTRACT

A backpack with an adjustable lumbar support belt, having a front panel, a bottom panel, and a top panel which define an interior capable of containing various items which create a load weighty. The front panel has a front panel extension which extends below the bottom surface of the pack. The lumbar support belt having a pair of lumbar belt straps which attach around the waist and a lumbar support body which is positioned against front panel extension and immediately below the bottom surface of the pack for supporting a portion of the weight of the pack upon the waist and hips.

10 Claims, 4 Drawing Sheets

BACKPACK WITH ADJUSTABLE LUMBAR SUPPORT BELT

BACKGROUND OF THE INVENTION

The invention relates to a backpack with adjustable lumbar support belt. More particularly, the invention relates to a backpack which includes a detachable and adjustable lumbar support belt which helps distribute the weight of the backpack on the wearer, away from the back of the wearer.

When full, a typical backpack can present a significant weight load upon the wearer. Unfortunately traditional backpacks place the majority of the weight on the shoulders and on the middle or lower back. A "soft" backpack will actually press downward and inward against the middle or lower back in a very painful and even harmful way. Hiking backpacks provide a framework which at least attempts to distribute the weight along the back. However typical backpacks provide very little support to the lower back. Accordingly the lower back suffers great strain when a person is toting around a backpack filled with heavy objects.

When wearing a conventional backpack, all weight supported by the upper body is typically compressed along the vertebral column, and the largest amount of pressure and chance of injury is ordinarily placed on the lumbar region of the spine since it is the last mobile segment of vertebrae in the human body (Lumbar 1–5). Excess stress on this region frequently results in misalignments which is responsible for many weight bearing spinal injuries.

What is needed is a backpack that will evenly distribute its weight load so that the strain on the lower back is not nearly as great.

Our previous U.S. Pat. Nos. 6,131,199 and Des. 426,051 disclose a combination vest and backpack which provides support to the lower back with a lumbar support. However in the realm of the traditional backpack there still exists a need for a system which effectively supports the lower back while redistributing the weight of the pack in a healthier manner.

Others have proposed systems which seek to provide alternatives to the conventional backpack. For example, U.S. Pat. No. 5,247,707 to Parker et al. discloses a utility vest with an integrally carried pack. U.S. Pat. No. 5,909,802 to Puco et al. discloses a vest backpack including a hood and a "mack". U.S. Pat. No. 5,797,143 to Buxton discloses a vest pack with back and neck supports. U.S. Pat. No. 5,634,579 to Baclawski discloses a backpack with integral vest. U.S. Pat. No. 5,913,409 to Test discloses a sportsman's vest for supporting a variety of articles used by shooters.

While these units may be suitable for the particular purpose employed, or for general use, they would not be as suitable for the purposes of the present invention as disclosed hereafter.

SUMMARY OF THE INVENTION

It is an object of the invention to produce a backpack which is well supported on the body so as to distribute weight in a healthier and more effective manner. Accordingly, the backpack distributes weight around the waist and hips using a lumbar support belt.

It is another object of the invention to provide a backpack which allows the lumbar support to be adjusted so that it effectively provides a shelf which directly supports the pack and accommodates wearers of different sizes, and different degrees of loading of the pack. Accordingly, a front panel extension extends below the bottom surface of the pack, and the lumbar support is selectively mateable with the front panel extension at various vertical positions thereon to engage and support the bottom surface of the pack to support the weight thereof.

The invention is a backpack with an adjustable lumbar support belt, having a front panel, a bottom panel, and a top panel which define an interior capable of containing various items which create a load weight. The front panel has a front panel extension which extends below the bottom surface of the pack. The lumbar support belt has a pair of lumbar belt straps which attach around the waist and a lumbar support body which is positioned against front panel extension and immediately below the bottom surface of the pack for supporting a portion of the weight of the pack upon the waist and hips.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
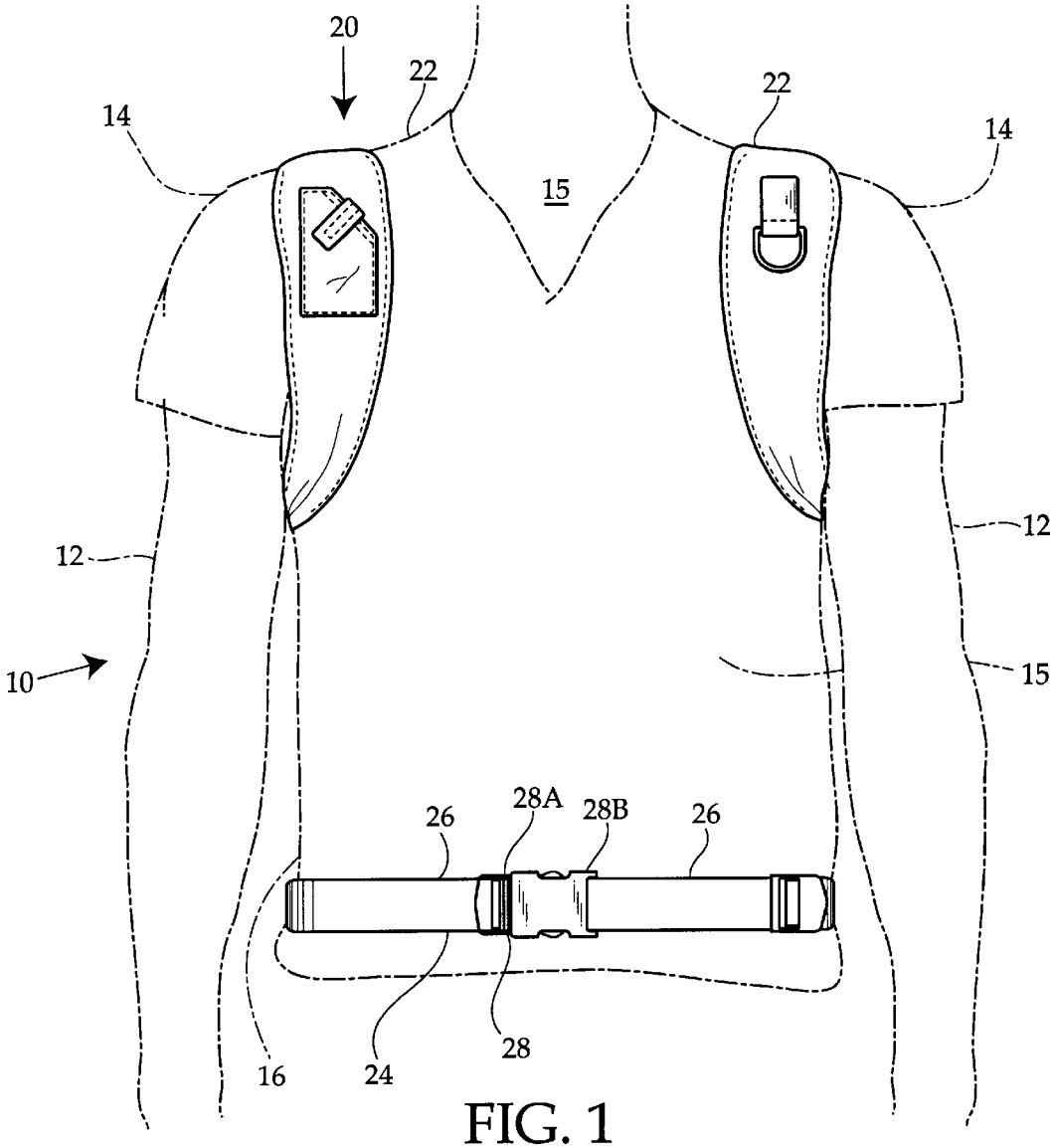
FIG. 1 is a front elevational view of a person wearing the backpack according to the present invention, wherein the shoulder straps extend over the wearer's shoulders, and the lumbar support belt extends around the user's waist.

FIG. 1 illustrates a person 10, having a pair of arms 12, a pair of shoulders 14, a front 15, and a waist 16. A backpack, designated throughout the following discussion generally by reference numeral 20, is being worn by the person 10. Most of the backpack 20 is extending behind the person. However, shoulder straps 22 are seen extending under the arms 12 and over the shoulders 14, and a lumbar support belt 24 is seen extending around the waist 16. The lumbar support belt 24 has a pair of lumbar support belt straps 26 which are shown joined with a coupler 28 having coupler halves 28A and 28B.

Figure 2:
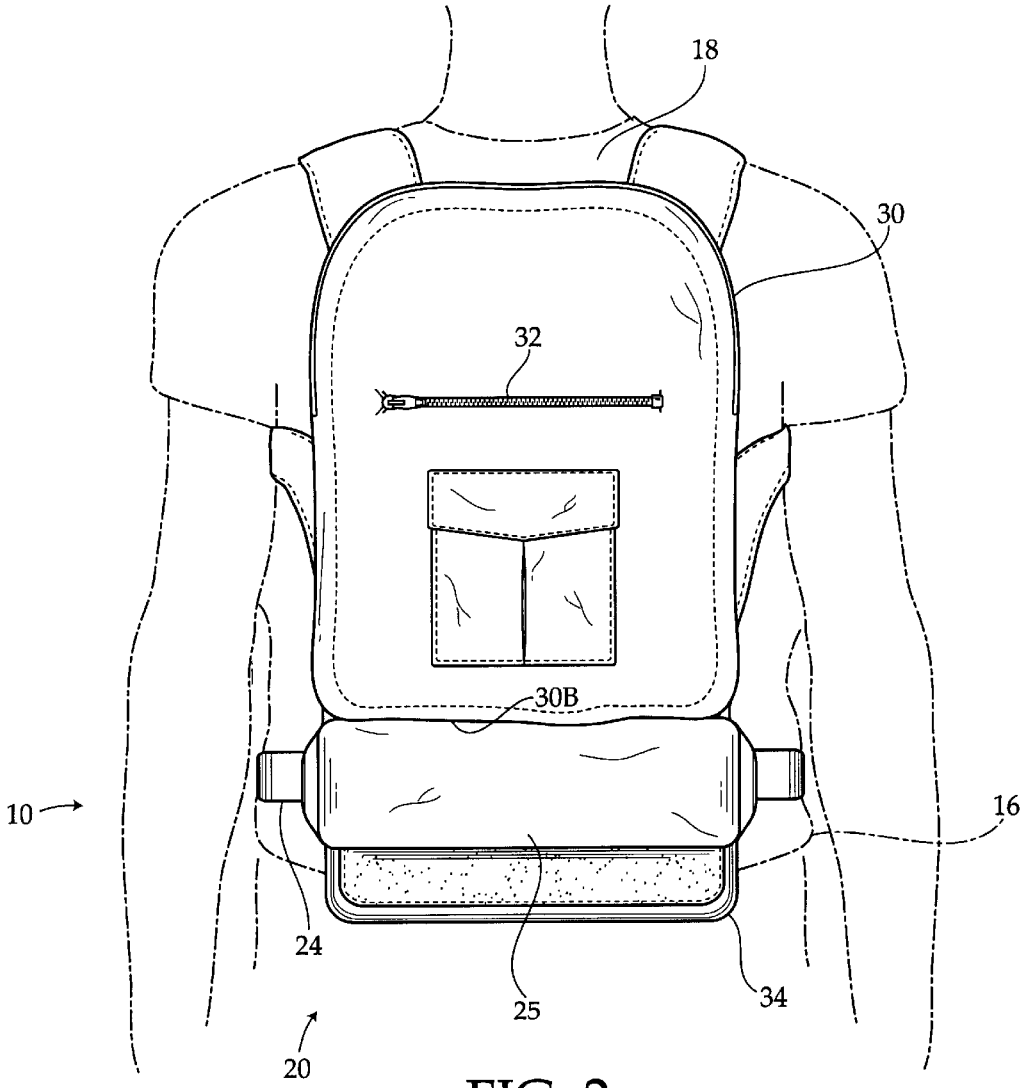
FIG. 2 is a rear elevational view, showing the backpack being worn, wherein the lumbar support belt is mated with the front panel extension to fix the position of the lumbar support belt which is supporting the pack.

FIG. 2 illustrates the backpack 20 being worn by the person 10, showing the back 18 of the person. The backpack 20 includes a pack 30 which generally provides a hollow vessel for carrying various objects in one or mote pockets. Such objects contribute to a "weight of the pack". Such pockets are accessible through pocket openings 32, which may be configured in ways so numerous that such is beyond the scope of the present discussion. However, preferably the pack is configured so that larger and heavier objects are stored in pockets closer to the body of the wearer to lessen the rearward "torquing" of the backpack.

The pack 30 has a bottom surface 30B, and a front panel extension 34 which extends below the bottom surface 30B. According to the present invention, the lumbar support belt 24 has a lumbar body 25 which is attached to the front panel extension 34 and sits immediately below the bottom surface 30B of the pack 30, providing a "shelf" which supports the weight of the pack 30. As the lumbar support belt 24 continues around the waist 16 of the person 10 and is mated securely as shown in FIG. 1, at least a portion of the weight of the pack is effectively redistributed around the waist 16 and is thereby supported upon the hips rather than the back.

Figure 3:
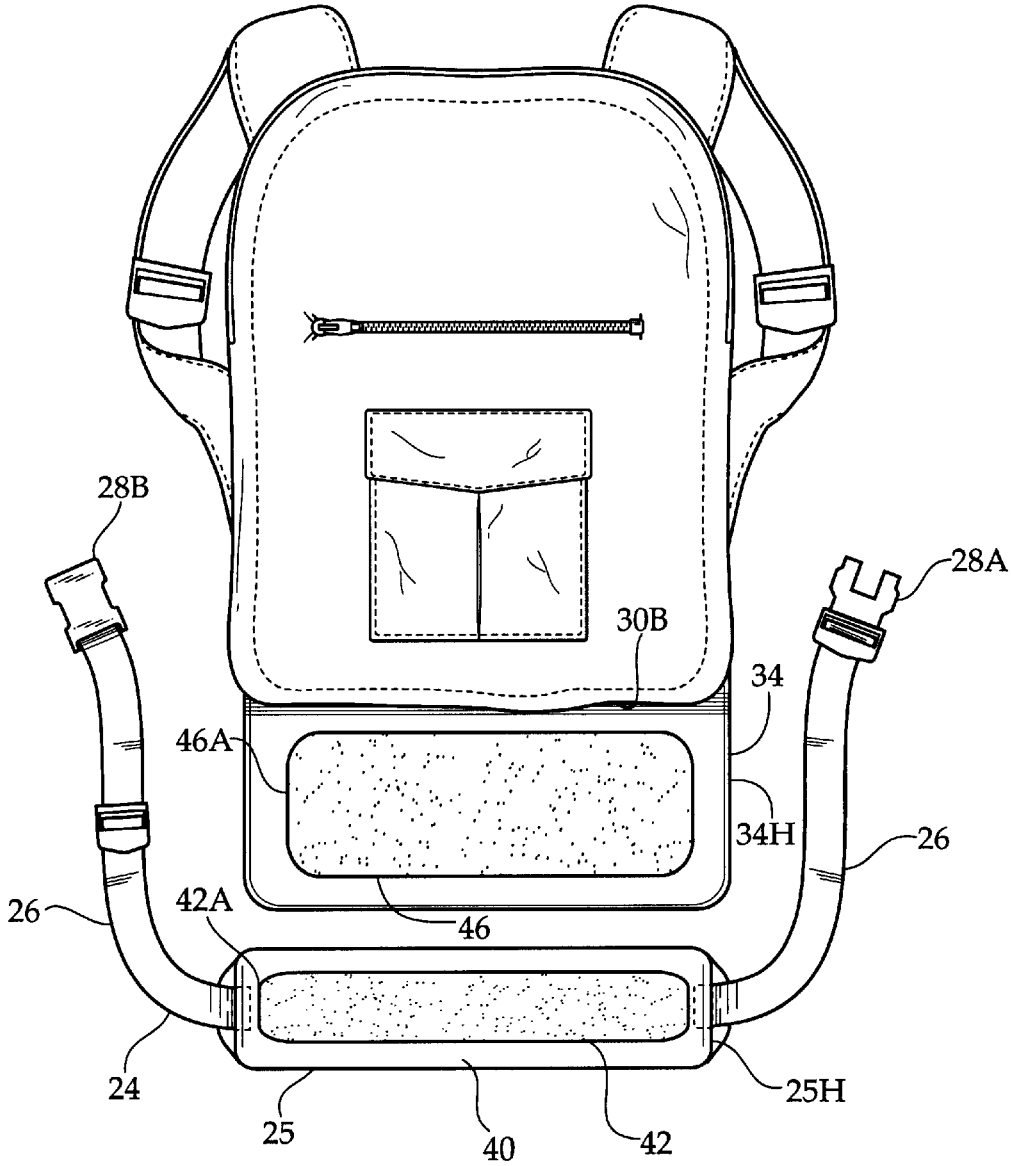
FIG. 3 is a rear elevational view of the backpack, wherein the lumbar support belt has been removed from the front panel extension and has been inverted to reveal fastener material for mating with the front panel extension.

In FIG. 3, the lumbar body 25 has been removed from the front panel extension 34 and the lumbar support belt 24 has been inverted. In particular, the lumbar body 25 has an inner surface 40 having a lumbar fastener patch 42 made of fastener material. The lumbar fastener patch 42 on the inner surface 40 of the lumbar body 25 has a lumbar fastener patch height 42A.

Also illustrated in FIG. 3, the front panel extension 34 has an extension fastener patch 46 having an extension fastener patch height 46A. The lumbar fastener patch 42 is made of material which is compatible with and thus selectively mateable with the extension fastener patch 46. The extension fastener patch height 46A is greater than the lumbar fastener patch 42 so that the lumbar body 25 is vertically positionable along the front panel extension 34 for adjusting the vertical position of the lumbar body 25 on the front panel extension 34.

In a similar regard, the lumbar body 25 has a lumbar body height 25H. The front panel extension 34 has a front panel extension height 34H which is defined as a vertical distance the front panel extension 34 extends below the pack bottom 30B. To facilitate further vertical adjustability of the lumbar support belt 24, the front panel extension height 34H is significantly greater than the lumbar body height 25H.

Also seen in FIG. 3, the lumbar support belt straps 26 are essentially coextensive with the inner surface 40 of the lumbar body 25 and extend from opposite sides thereof. The coupler halves are each located on one of the lumbar support belt straps 26 at an opposite end thereof from the lumbar body 25. Accordingly, when the coupler halves 28A and 28B are joined, a closed loop is formed with the lumbar support belt straps 26 and the lumbar body 25. Of course, the lumbar support belt straps 26 may be adjustable in length in a conventional manner.

Figure 4:
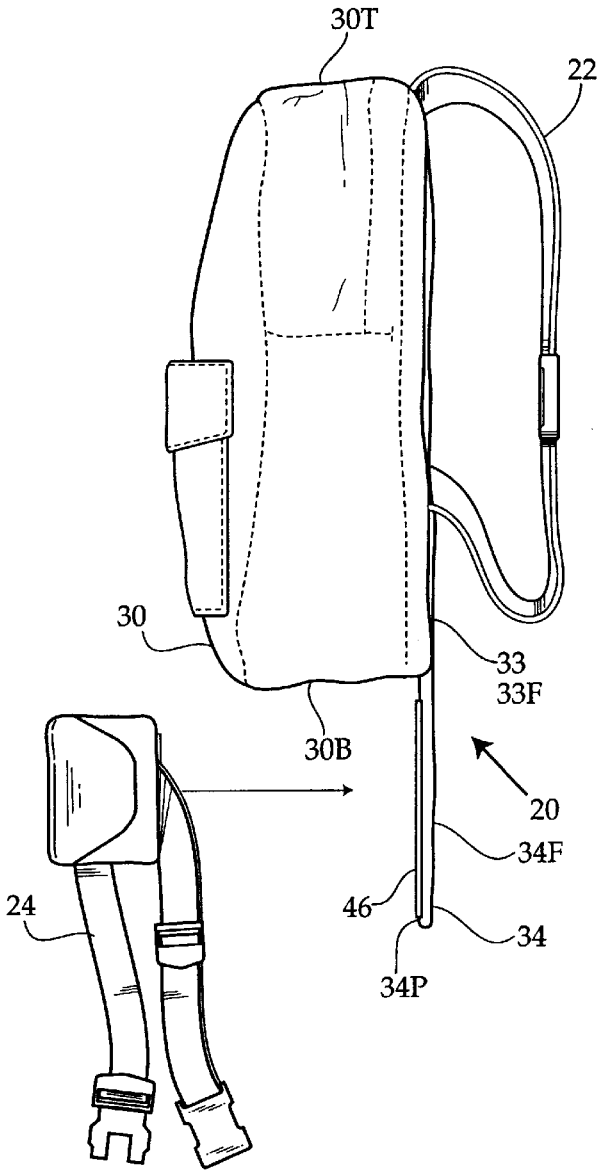
FIG. 4 is a side elevational view of the backpack, wherein the lumbar support belt is about to be attached to the front panel extension.

In FIG. 4, the lumbar support belt 24 is about to be positioned upon the front panel extension 34. In FIG. 4, further details regarding the backpack 20 are detailed. In particular, the backpack 20 has a front panel 33 from which the pack 30 essentially projects rearward. The front panel 33 has a front surface 33F which normally contacts and extends vertically along the back 18 of the person 10 wearing the backpack 20. Unconventionally, the front panel 33 extends below the bottom surface 30B of the pack 30, which allows for the attachment of the lumbar support belt 24. The front panel extension 34 may simply be a continuance of the front panel 33, such that the same piece of fabric (canvas, vinyl, etc.) that defines the hollow interior of the pack 30 is simply continued below the bottom surface 30B of the pack 30 to facilitate the attachment of the lumbar support belt 24. The front panel extension 34 has a front panel extension front surface 34F which is continuous with the front panel front surface 33F. For attaching the lumbar support belt 24, the front panel extension 34 has a front panel extension posterior surface 34P, opposite from the front panel extension front surface 34F which has the extension fastener patch 46.

Also in FIG. 4, the shoulder straps 22 generally extend from the pack 30, wherein the pack has a top 30T opposite from the bottom 30B, and the shoulder straps 22 each extend from near the top 30T of the pack 30 and are reattached toward the bottom 30B to form a loop through which the arms of the person are inserted. The shoulder straps 22 may also be made adjustable in length in a conventional fashion.

Figure 5:
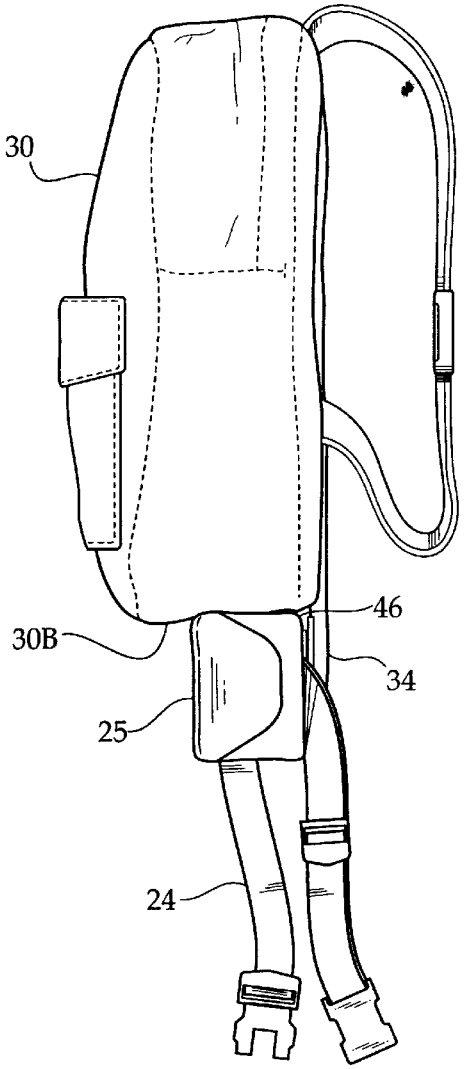
FIG. 5 is a side elevational view of the backpack, wherein the lumbar support belt has been attached to the front panel extension, and is providing a shelf which is supporting the pack.

Now referring to FIG. 5, the lumbar body 25 has been affixed to the posterior surface 34P of the front panel extension 34, by attaching the lumbar fastener patch 42 to the extension fastener patch 46. The lumbar body 25 has been suitably positioned so that it is creating a weight-bearing shelf beneath the bottom surface 30B of the pack 30 to help support the weight of the pack 30. As the relative vertical position of the lumbar body 25 with respect to the pack 30 is fixed by virtue of the connection between the lumbar body 25 to the front panel extension 34, the weight of the pack is communicated to the lumbar support belt 24. Accordingly, when the lumbar support belt 24 is properly attached around the waist of the wearer as shown in FIG. 1 and FIG. 2, the weight of the pack is partially redistributed to the waist and hips of the wearer, and directed away from the lower back. Weight supported and redistributed by the lumbar support belt 24 also partially relieves the shoulders of its burden—which would otherwise often translate into further stress to the back.

In addition to allowing the lumbar body 25 to be positioned where it most effectively supports the pack 30, the extension fastener patch 46 allows the lumbar body 25 to be positioned according to the size of the particular person wearing the backpack 20. In particular, it is preferable that the lumbar support is positioned over the lumbar region of the vertebral column—the lower back, along the spine, below the ribcage, and where the spine connects to the hips. Accordingly, once the lumbar support belt 24 is secured around the waist 16, a force is created along the lumbar region of the spine that is able to create better support for the vertical alignment and compression of the lower spinal vertebrae. As all weight on the body is typically compressed along the vertebral column, and the largest amount of pressure and chance of injury is ordinarily placed on the lumbar region of the spine since it is the last mobile segment of vertebrae in the human body (Lumbar 1—5), the lumbar support helps alleviate stress on this region. By relieving some of this stress, the lumbar support belt creates additional support to avoid misalignments responsible for many weight bearing spinal injuries.

In addition, beyond redistributing the weight of the pack, the lumbar body 25 provides actual "lumbar support" to the lower back. In this regard the lumbar support belt 24, when properly attached provides significant comfort, weight distribution, and safety advantages.

In conclusion, herein is presented a system for providing a backpack which allows a load weight within its pack to be effectively redistributed upon a wearer by using a lumbar support belt worn around the waist which attaches to the pack to act as a shelf for the pack and thereby take a significant load off of the shoulders and lower back. In this regard, the invention may be embodied in the form illustrated in the accompanying drawings. However, these drawings and the foregoing description are illustrative only of the inventive concept. Numerous variations are possible while adhering to the principles of the present invention. Such variations are contemplated as being a part of the present invention.

What is claimed is:

1. A backpack, for use by a wearer having a pair of arms, a pair of shoulders, a front, a back, and a waist, comprising:

a pack, the pack having a front panel having a front panel front surface, a top, and a bottom surface, together defining a hollow interior for supporting a load weight;

a pair of shoulder straps which each extend from near the pack top near the front panel to near the pack bottom near the front panel, wherein the arms of the person are inserted through the shoulder straps such that each shoulder strap extends over one of the shoulders of the wearer;

a front panel extension, extending coextensive with the front panel of the pack below the bottom surface of the pack, having a front panel extension front surface substantially coplanar with the front panel front surface, and a front panel extension posterior surface opposite from the front panel extension front surface; and a lumbar support belt, having a lumbar body, a pair of lumbar belt straps each extending from opposite sides of the lumbar body, and a coupler for selectively attaching the lumbar belt straps, the lumbar support belt extending around the waist of the wearer and coupling at the front of the wearer such that the lumbar body extends against the front panel extension and creates a shelf which supports the bottom surface of the pack, wherein the lumbar body has an interior surface having a lumbar fastener patch made of fastener material, wherein the front panel extension posterior surface has a extension fastener patch made of fastener material, and wherein the lumbar body is selectively mateable with the front panel extension by securing the lumbar fastener patch to the extension fastener patch.

2. The back pack as recited in claim 1, wherein the lumbar body has a lumbar body height, wherein the front panel extension has a front panel extension height, and wherein the front panel extension height is greater than the lumbar support height to allow significant vertical adjustability of the lumbar body on the front panel extension.

3. The back pack as recited in claim 2, wherein the extension fastener patch has an extension fastener patch height, wherein the lumbar fastener has a lumbar fastener patch height, and wherein the extension fastener patch height is greater than the lumbar fastener patch height to allow variance of vertical positioning of the lumbar body on the front panel extension.

4. The backpack as recited in claim 3, wherein the lumbar belt straps are substantially coextensive with the inner surface of the lumbar body.

5. A backpack support system, for use by a wearer having a back, arms, shoulders, a waist, and a front, using a backpack having a pack having a front panel, a bottom surface, and a top surface defining a hollow interior capable of containing a load weight, a front panel extension which continues downward from the front panel below the bottom surface of the pack, and a lumbar support belt having a lumbar body, a pair of lumbar belt straps and a lumbar belt coupler for selectively joining the lumbar belt straps, comprising the steps of:

donning the backpack by extending the front panel against the back of the wearer;

positioning the lumbar body beneath the bottom surface of the pack; and supporting the bottom surface of the pack by the lumbar body by pulling the lumbar body tightly against the front panel extension by fastening the lumbar belt around the waist of the user by coupling the lumbar belt coupler, wherein the backpack has a pair of shoulder straps extending from adjacent the front panel and top surface to adjacent the front panel and bottom surface, and wherein the step of donning the backpack further comprises extending each of the arms of the wearer through the shoulder straps and each of the shoulder straps over one of the shoulders of the wearer, and wherein the front panel has a front panel front surface, wherein the front panel extension has a front panel extension front surface coplanar with the front panel front surface and a front panel extension posterior surface opposite from the front panel extension front surface, and wherein the step of pulling the lumbar body tightly against the front panel extension further comprises pulling the lumbar body tightly against the front panel extension posterior surface, and wherein the front panel extension has an extension fastener patch made of fastener material, and wherein the lumbar body has an inner surface having a lumbar fastener patch, and wherein the step of supporting the bottom surface of the pack further comprises mating the lumbar fastener patch with the extension fastener patch.

6. The backpack support system as recited in claim 5, wherein the front panel extension has a front panel extension height, wherein the lumbar body has a lumbar body height, wherein the front panel extension height is greater than the lumbar body height, and wherein the step of supporting the bottom surface of the pack further comprises engaging the bottom surface of the pack by vertically adjusting the lumbar body along the front panel extension.

7. A backpack, for use by a wearer having a pair of arms, a pair of shoulders, a front, a back, and a waist, comprising:

a pack, the pack having a front panel having a front panel front surface, a top, and a bottom surface, together defining a hollow interior for supporting a load weight;

a front panel extension, extending coextensive with the front panel of the pack below the bottom surface of the pack, having a front panel extension front surface substantially coplanar with the front panel front surface, and a front panel extension posterior surface opposite from the front panel extension front surface; and a lumbar support belt, having a lumbar body, a pair of lumbar belt straps each extending from opposite sides of the lumbar body, and a coupler for selectively attaching the lumbar belt straps, the lumbar support belt extending around the waist of the wearer and coupling at the front of the wearer such that the lumbar body extends against the front panel extension and creates a shelf which supports the bottom surface of the pack, and wherein the lumbar body has an interior surface having a lumbar fastener patch made of fastener material, and wherein the front panel extension posterior surface has a extension fastener patch made of fastener material, and wherein the lumbar body is selectively mateable with the front panel extension by securing the lumbar fastener patch to the extension fastener patch.

8. The back pack as recited in claim 7, wherein the lumbar body has a lumbar body height, wherein the front panel extension has a front panel extension height, and wherein the front panel extension height is greater than the lumbar support height to allow significant vertical adjustability of the lumbar body on the front panel extension.

9. The back pack as recited in claim 8, wherein the extension fastener patch has an extension fastener patch height, wherein the lumbar fastener has a lumbar fastener patch height, and wherein the extension fastener patch height is greater than the lumbar fastener patch height to allow variance of vertical positioning of the lumbar body on the front panel extension.

10. The backpack as recited in claim 9, wherein the lumbar belt straps are substantially coextensive with the inner surface of the lumbar body.

* * * * *